US009942663B1

(12) United States Patent
Salvatti et al.

(10) Patent No.: US 9,942,663 B1
(45) Date of Patent: Apr. 10, 2018

(54) ELECTROMAGNETIC TRANSDUCER HAVING PAIRED HALBACH ARRAYS

(71) Applicant: Apple Inc., Cupertino, CA (US)

(72) Inventors: Alexander V. Salvatti, Morgan Hill, CA (US); Onur I. Ilkorur, Campbell, CA (US); Pablo Seoane Vieites, Sunnyvale, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 15/389,126

(22) Filed: Dec. 22, 2016

(51) Int. Cl.

| | |
|---|---|
| ***H04R 1/00*** | (2006.01) |
| ***H04R 9/02*** | (2006.01) |
| ***H04R 9/04*** | (2006.01) |
| ***H04R 9/06*** | (2006.01) |

(52) U.S. Cl.
CPC ..... *H04R 9/025* (2013.01); *H04R 9/047* (2013.01); *H04R 9/06* (2013.01); *H04R 2209/022* (2013.01); *H04R 2499/11* (2013.01)

(58) Field of Classification Search
CPC ..... H04R 9/025; H04R 2209/022; H04R 2209/024; H02K 41/02
See application file for complete search history.

(56) References Cited

U.S. PATENT DOCUMENTS

| | | | | |
|---|---|---|---|---|
| 6,906,789 | B2 * | 6/2005 | Carter | G03F 7/70066 355/71 |
| 7,031,116 | B2 | 4/2006 | Subrahmanyan | |
| 7,450,729 | B2 | 11/2008 | Nguyen et al. | |
| 7,929,726 | B1 | 4/2011 | Jones | |
| 2002/0054458 | A1 | 5/2002 | Subrahmanyan | |
| 2005/0264108 | A1 | 12/2005 | Devaney et al. | |
| 2006/0188120 | A1 * | 8/2006 | Fisher | H04R 9/025 381/338 |
| 2009/0016563 | A1 | 1/2009 | Wei et al. | |
| 2015/0003662 | A1 | 1/2015 | Vernon et al. | |
| 2016/0197544 | A1 | 7/2016 | Wu | |
| 2016/0212545 | A1 * | 7/2016 | Morgan | H04R 9/025 |
| 2016/0212546 | A1 * | 7/2016 | Salvatti | H04R 9/06 |

FOREIGN PATENT DOCUMENTS

| | | | | |
|---|---|---|---|---|
| AU | 2014201937 | A1 | 10/2014 | |
| CN | 104469629 | | 3/2015 | |
| GB | 2515518 | A * | 12/2014 | H04R 3/00 |

OTHER PUBLICATIONS

"Audeze Planars", Audeze, https://www.audeze.com/technology/tech-tour/audeze-planars, Dec. 10, 2014, 1 pg.
Tyll Hertsens,"How Planar Magnetic Headphones Work", May 11, 2001, 6 pages.

* cited by examiner

*Primary Examiner* — Matthew Eason
*Assistant Examiner* — Ryan Robinson
(74) *Attorney, Agent, or Firm* — Womble Bond Dickinson (US) LLP

(57) ABSTRACT

An electromagnetic transducer, such as an audio speaker, having a voicecoil disposed within a magnetic gap between a pair of magnetic arrays, e.g., Halbach arrays, is disclosed. In an example, the paired Halbach arrays include vertically-poled magnets to direct magnetic flux across the magnetic gap orthogonal to electrical current carried by a planar winding of the voicecoil. Accordingly, a Lorentz force may drive an oscillational mass, e.g., a speaker diaphragm, in a longitudinal direction orthogonal to the magnetic flux and the electrical current to generate vibration or sound. Other embodiments are also described and claimed.

20 Claims, 12 Drawing Sheets

ELECTROMAGNETIC TRANSDUCER HAVING PAIRED HALBACH ARRAYS

BACKGROUND

Field

Embodiments related to electromagnetic transducers having several Halbach arrays, are disclosed. More particularly, embodiments related to electromagnetic transducers having a voicecoil between a pair of Halbach arrays, are disclosed.

Background Information

An electromagnetic transducer converts an electrical input signal into a mechanical force. For example, a haptic feedback device may include an electromagnetic transducer to convert an electrical signal into a vibration. Similarly, an audio speaker may include an electroacoustic transducer to convert an electrical audio signal into a sound. An electromagnetic transducer typically includes a motor assembly to generate a force to drive a mass, such as a speaker diaphragm. The motor assembly may include a voicecoil, which typically includes a helical winding disposed in a gap of a magnetic circuit. The magnetic circuit may direct a magnetic field perpendicular to the helical winding such that, when the voicecoil is energized by an electrical input signal, a mechanical force is generated to cause the voicecoil to move back and forth within the gap.

SUMMARY

Portable consumer electronic devices, such as mobile phones, have continued to become more and more compact. As the form factor of such devices shrinks, system enclosures become smaller and the space available for component integration is reduced. In particular, the trend toward reducing a thickness of these devices (the so-called "z-height") has generally been a primary challenge for the integration of audio or vibration transducers. In the case of an audio speaker having a voicecoil suspended within a gap of a magnetic circuit, precious space is occupied by a magnetic return structure that is required to direct the magnetic field toward the voicecoil. More particularly, since the voicecoil and the magnetic return structure typically extend along an axis of sound emission, some of the overall z-height required for excursion of the speaker diaphragm is taken up by the motor assembly. Accordingly, the speaker diaphragm may no longer fit within the available z-height, and it may become necessary to separate the motor assembly and the speaker diaphragm. That is, the motor assembly may be coupled to the speaker diaphragm to drive the diaphragm and the generated sound in another direction, e.g., a direction lateral to the z-height.

In an embodiment, an electromagnetic transducer includes paired magnetic Halbach arrays forming a magnetic gap, and a voicecoil within the magnetic gap. Electrical current in the voicecoil may interact with magnetic flux in the magnetic gap to generate a Lorentz force that moves the voicecoil axially along a longitudinal axis. An oscillational mass may be coupled to the voicecoil, and thus, the Lorentz force may drive the oscillational mass along the longitudinal axis. In an embodiment, the oscillational mass includes a speaker diaphragm, and thus, the electromagnetic transducer may be an electroacoustic transducer.

Paired magnetic Halbach arrays of the electromagnetic transducer and/or electroacoustic transducer may include an upper magnetic Halbach array separated from a lower magnetic Halbach array by the magnetic gap. Each magnetic Halbach array may include an upward-poled magnet and a downward-poled magnet, and the upward-poled magnets and downward-poled magnets of the Halbach arrays may be aligned along respective vertical axes. That is, the upward-poled magnets may be aligned along a first vertical axis to direct magnetic flux upward through the magnetic gap, and the downward-poled magnets may be aligned along a second vertical axis to direct magnetic flux downward through the magnetic gap. A planar winding of the voicecoil may include transverse conductors aligned with the vertical axes. For example, a first transverse conductor may conduct electrical current leftward orthogonal to the first vertical axis, and a second transverse conductor may conduct electrical current rightward orthogonal to the second vertical axis. Accordingly, the interaction between the transverse conductors and the respective pairs of vertically-poled magnets may produce respective Lorentz forces that drive the voicecoil in a same direction, e.g., in the longitudinal direction.

The Lorentz force may be controlled by varying structural features of the electromagnetic motor assembly. For example, the planar winding may include several conformal winding lengths or coiled winding lengths having transverse winding segments disposed adjacent to each other. A width across the transverse winding segments may be greater than a width of the vertically-poled magnets such that at least a portion of the transverse conductor remains within the magnetic flux when the voicecoil oscillates to a maximum excursion in the longitudinal direction. In an embodiment, each magnetic Halbach array includes an end magnet extending between vertically-poled magnets of the same array. The end magnets may also be poled in a vertical direction such that longitudinal segments of the planar winding can be disposed between the end magnets of the paired arrays, within the magnetic gap, to generate an additional Lorentz force on the voicecoil.

An electroacoustic transducer incorporating the paired magnetic Halbach arrays may include several diaphragms and/or several voicecoils. For example, the electroacoustic transducer may include several diaphragms connected to a same voicecoil and driven in unison by the voicecoil. The electroacoustic transducer may include several independently driven voicecoils, and each voicecoil may be connected to a respective diaphragm such that the diaphragms generate sound independently from each other. In an embodiment, a speaker may include several acoustic cells incorporating respective electroacoustic transducers that are independently driven by different audio channels. The electrical audio signals may be controlled such that the acoustic cells can direct sound in a beam forming application.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

DETAILED DESCRIPTION

Figure 1:
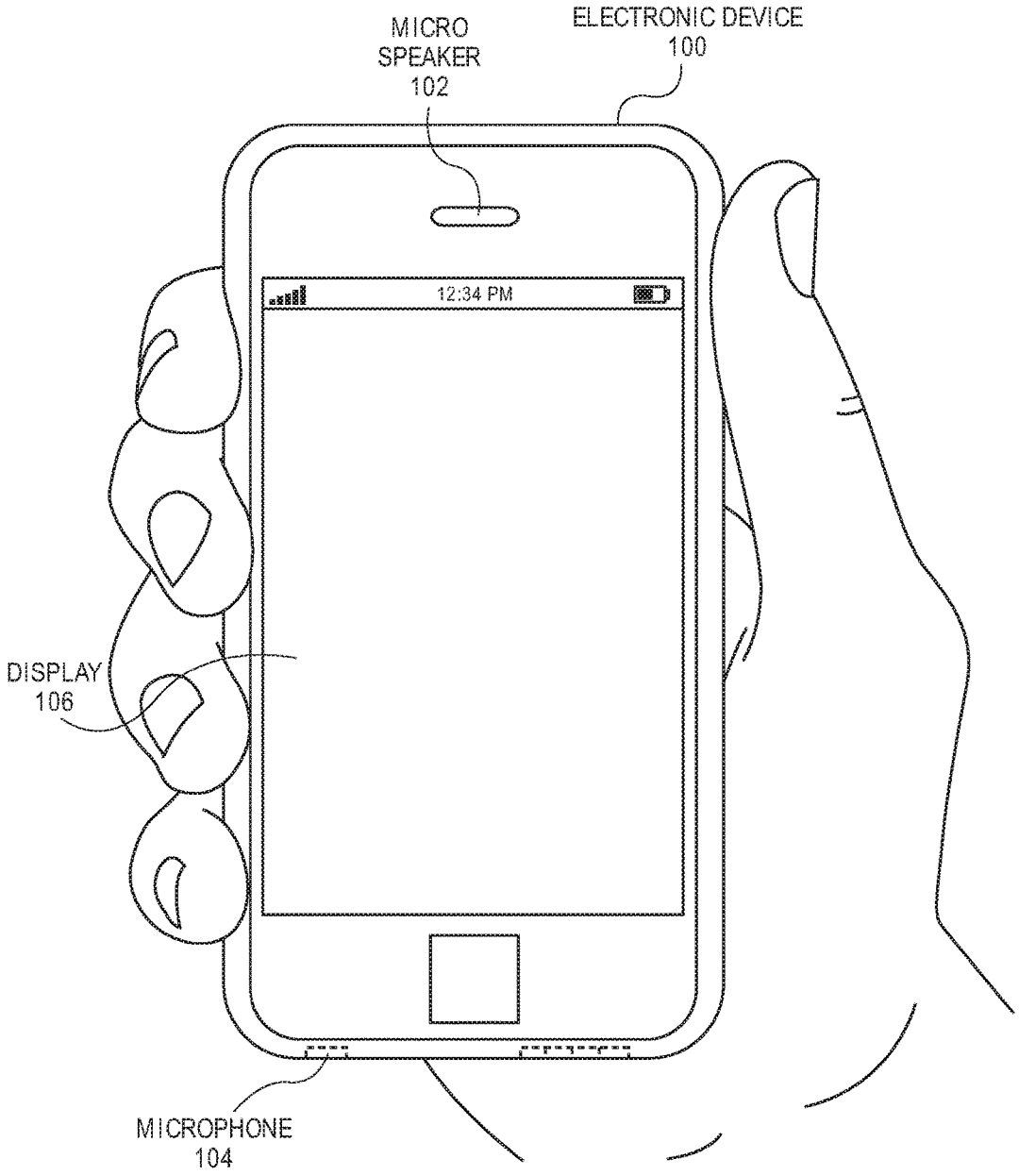
FIG. 1 is a pictorial view of a mobile electronic device in accordance with an embodiment of the invention.

Embodiments describe an electromagnetic transducer, such as an audio speaker, having a voicecoil disposed within a magnetic gap between a pair of magnetic arrays, e.g., Halbach arrays. While some embodiments are described with specific regard to integration within mobile electronic devices, such as handheld devices, the embodiments are not so limited and certain embodiments may also be applicable to other uses. For example, a haptic feedback mechanism or an audio speaker as described below may be incorporated into other devices and apparatuses, including desktop computers, laptop computers, or tablet computers, to name only a few possible applications. Similarly, although the following description commonly refers to an audio speaker as being a "microspeaker", this description is not intended to be limiting, and an audio speaker as described below may be scaled to any size and emit any range of frequencies.

In various embodiments, description is made with reference to the figures. However, certain embodiments may be practiced without one or more of these specific details, or in combination with other known methods and configurations. In the following description, numerous specific details are set forth, such as specific configurations, dimensions, and processes, in order to provide a thorough understanding of the embodiments. In other instances, well-known processes and manufacturing techniques have not been described in particular detail in order to not unnecessarily obscure the description. Reference throughout this specification to "one embodiment," "an embodiment," or the like, means that a particular feature, structure, configuration, or characteristic described is included in at least one embodiment. Thus, the appearance of the phrase "one embodiment," "an embodiment," or the like, in various places throughout this specification are not necessarily referring to the same embodiment. Furthermore, the particular features, structures, configurations, or characteristics may be combined in any suitable manner in one or more embodiments.

The use of relative terms throughout the description may denote a relative position or direction. For example, "upward" or "above" may indicate a first axial direction away from a reference point. Similarly, "downward" or "below" may indicate a location in a second direction from the reference point opposite to the first axial direction. However, such terms are not intended to limit the use of an electromagnetic transducer to a specific configuration described in the various embodiments below. For example, a microspeaker may be oriented to radiate sound in any direction with respect to an external environment, including upward toward the sky and downward toward the ground.

In an aspect, an electromagnetic transducer and/or an electroacoustic transducer incorporating paired magnetic Halbach arrays are disclosed. The paired magnetic Halbach arrays can drive a voicecoil in a longitudinal direction parallel to a plane along which the Halbach magnets are arranged. More particularly, respective vertically-poled magnets of the paired magnetic Halbach arrays may be aligned along a vertical axis passing through a transverse conductor of the voicecoil to drive the voicecoil in a longitudinal direction orthogonal to both the vertical and transverse directions. By driving the voicecoil in the longitudinal direction, and not the vertical direction, the vertical direction of the transducers may be reduced. Accordingly, the transducer may have a thinner form factor.

Referring to FIG. 1, a pictorial view of a mobile electronic device is shown in accordance with an embodiment of the invention. An electronic device 100 may be a smartphone device. Alternatively, it could be any other portable or stationary device or apparatus incorporating an electromagnetic or electroacoustic transducer, e.g., a haptic feedback mechanism or a microspeaker. For example, electronic device 100 may be a laptop computer or a tablet computer. Electronic device 100 may include various capabilities to allow the user to access features involving, for example, calls, voicemail, music, e-mail, Internet browsing, scheduling, and photos. Electronic device 100 may also include hardware to facilitate such capabilities. For example, electronic device 100 may include cellular network communications circuitry. An integrated microphone 104 may pick up the voice of its user during a call, and microspeaker may deliver a far-end voice to the near-end user during the call. Microspeaker may also emit sounds associated with music files played by a music player application running on electronic device 100. A display 106 may be integrated within a housing of electronic device 100 to present the user with a graphical user interface to allow a user to interact with electronic device 100 and applications running on electronic device 100. The housing may enclose a vibration device (not shown) to provide haptic feedback to a user when the user grips the housing. The housing may be sized to be gripped comfortably by the user. Other conventional features are not shown but may of course be included in electronic device 100.

Electronic device 100 may have a thin profile, and thus, may have limited space, e.g., z-height, available for integration of the electromagnetic or electroacoustic transducer. For example, electronic device 100 may have a z-height that is insufficient to fit an audio speaker having a helically wound voicecoil and magnetic return structure extending away from a diaphragm, as described above. Accordingly, electronic device 100 may benefit from a transducer motor assembly having a topology with a shallow depth and a motor assembly that does not require a helically wound voicecoil or a magnetic return structure.

Figure 2:
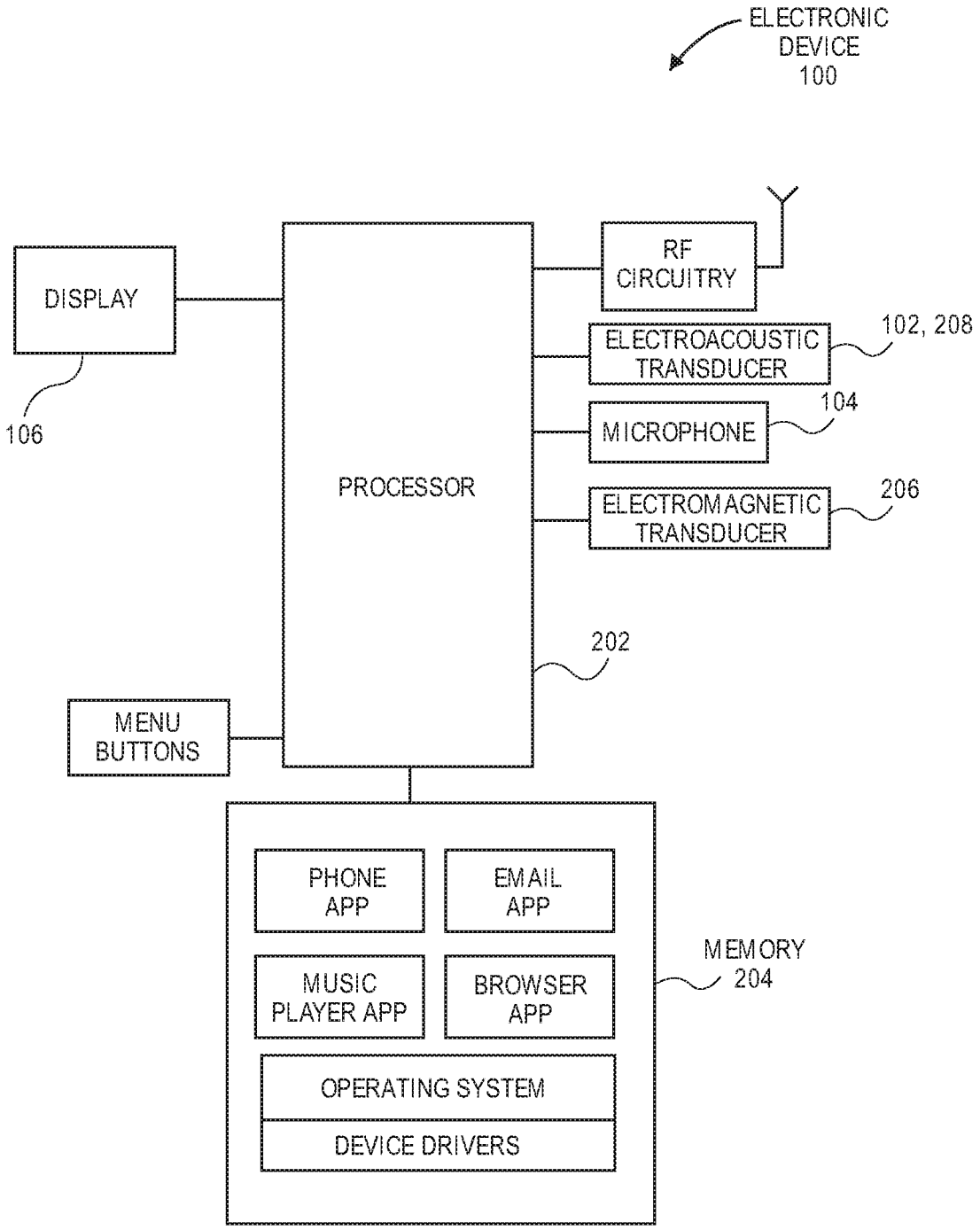
FIG. 2 is a block diagram of a mobile electronic device in accordance with an embodiment.

Referring to FIG. 2, a block diagram of a mobile electronic device is shown in accordance with an embodiment. As described above, electronic device 100 may be one of several types of portable or stationary devices or apparatuses with circuitry suited to specific functionality. For example, electronic device 100 may be a mobile phone handset, as shown in FIG. 1. Accordingly, electronic device 100 may include a housing (not shown) to contain or support various components, such as cellular network communications circuitry, e.g., RF circuitry, menu buttons, or display 106. Electronic device 100 may contain a haptic feedback mechanism, and more particularly, an electromagnetic transducer 206 to generate vibrations as haptic feedback for a user. Electronic device 100 may contain microspeaker 102, and more particularly, an electroacoustic transducer 208 to generate sound.

The diagrammed circuitry of FIG. 2 is provided by way of example and not limitation. Electronic device 100 may include one or more processors 202 that execute instructions to carry out the different functions and capabilities described above. For example, processor 202 may incorporate and/or communicate with electronics connected to electromagnetic transducer 206 or electroacoustic transducer 208 to provide electrical signals to drive the transducers. For example, an electrical signal may drive a voicecoil to generate mechanical vibration and/or audio output for electronic device 100. Instructions executed by the one or more processors 202 of electronic device 100 may be retrieved from a local memory 204, and may be in the form of an operating system program having device drivers, as well as one or more application programs that run on top of the operating system, to perform the different functions introduced above, e.g., music play back.

Figure 3A:
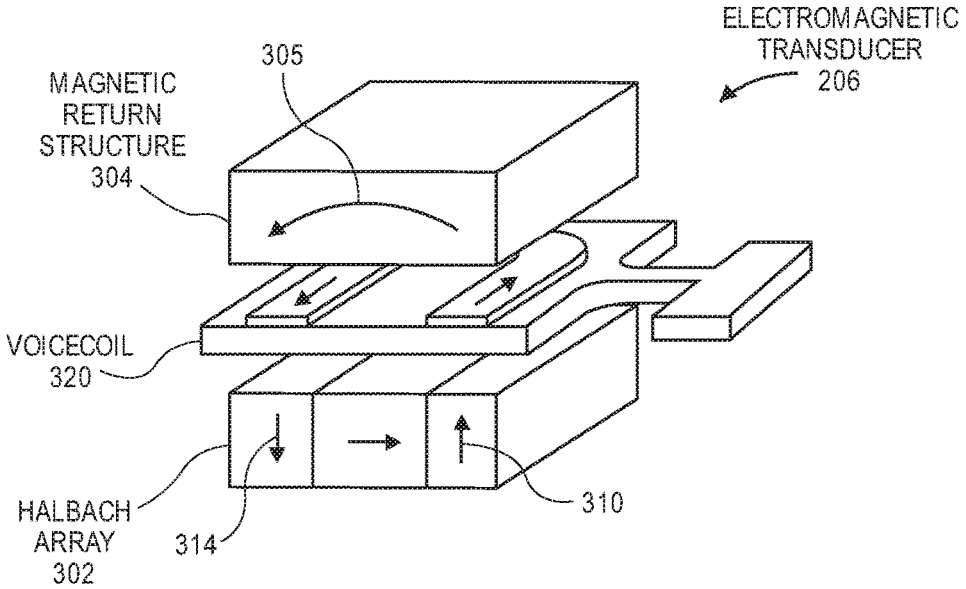
FIGS. 3A-3B are pictorial views of an electromagnetic transducer in accordance with an embodiment.
Figure 3B:
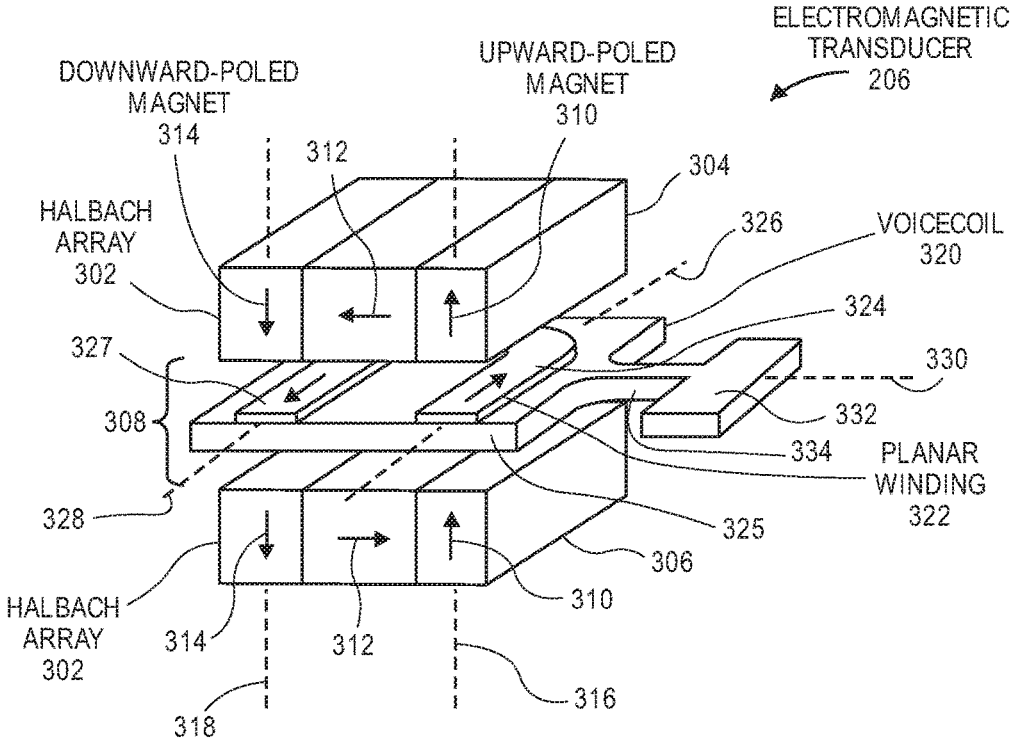

Referring to FIGS. 3A-3B, pictorial views of an electromagnetic transducer are shown in accordance with an embodiment. An electromagnetic transducer 206 may convert electrical signals from processor 202 into mechanical movements of a transducer component.

FIG. 3A illustrates electromagnetic transducer 206 incorporating a magnetic Halbach array 302 paired with a magnetic return structure 304. The structure of electromagnetic transducer 206, and in particular magnetic Halbach array 302, is described further beginning with FIG. 3B. The structure may be referred to as a single-sided Halbach array. FIG. 3A, however, illustrates that magnetic return structure 304 may provide a return path for flux 305 from magnetic Halbach array 302 on an opposite side of a voicecoil 320. Magnetic return structure 304 may be a ferromagnetic sheet of material, e.g., a steel plate. Accordingly, magnetic flux directed toward magnetic return structure 304 through voicecoil 320 from an upward-poled magnet 310 of magnetic Halbach array 302 may be returned to a downward-poled magnet 314 of Halbach array 302 through voicecoil 320 from magnetic return structure 304.

Referring to FIG. 3B, magnetic return structure 304 may be a second magnetic Halbach array 302. More particularly, electromagnetic transducer 206 may incorporate paired Halbach arrays 302. The structure may be referred to as a dual- or two-sided Halbach array. That is, a pair of Halbach arrays 302 of electromagnetic transducer 206 may include an upper magnetic Halbach array 304 and a lower magnetic Halbach array 306. Substantial description of paired Halbach array structures is provided below, but it will be appreciated that the single-sided and dual-sided Halbach array structures of FIGS. 3A-3B may both be useful embodiments for certain applications. For example, a dual-sided Halbach array structure having dimensions as described below with respect to FIG. 5 may have a transduction coefficient (BL) of 1.02 Tesla-meters. Comparatively, a single-sided Halbach array structure having dimensions similar to those described below with respect to FIG. 5, with the exception of replacing one Halbach array with a carbon steel plate, may have a transduction coefficient (BL) of 0.84 Tesla-meters. Accordingly, it has been shown that paired Halbach arrays can provide an increase in transduction coefficient of 17%. Nonetheless, a transduction coefficient of both embodiments may be sufficiently high to be useful, and the increase in transduction coefficient for a paired Halbach array structure may be counterbalanced by an increase in design complexity. Thus, either single-sided or dual-sided Halbach array structures may be incorporated in electromagnetic transducer 206 as is otherwise described throughout the following description.

Each Halbach array of the pair of Halbach arrays 302 may have a similar structure. For example, a basic cell of the Halbach arrays 302 may include at least three magnets, e.g., bar magnets of any length, sequentially arranged side-by-side along a plane. That is, the Halbach arrays 302 may be planar. Each magnet of the Halbach array 302 may be poled in a respective direction, and the direction of poling for each magnet may be 90° or −90° relative to an adjacent magnet. By way of example, a rightmost magnet of upper Halbach array 304 may be an upward-poled magnet 310, a middle magnet of upper Halbach array 304 may be a longitudinally-poled magnet 312, e.g., poled—90° relative to upward-poled magnet 310, and a leftmost magnet of upper Halbach array 304 may be a downward-poled magnet 314. Lower Halbach array 306, like upper Halbach array 304, may have a respective upward-poled magnet 310 and downward-poled magnet 314. Furthermore, longitudinally-poled magnet 312 between the vertically-poled magnets of lower Halbach array 306 may be poled 90° relative to upward-poled magnet 310 of lower Halbach array 306.

Although the magnets of Halbach arrays 302 are illustrated having rectangular cross-sections, it will be appreciated that the magnets may have other cross-sectional profiles. For example, the magnets may include triangular, circular, trapezoidal, or other cross-sectional profiles. In an embodiment, the cross-sectional profiles of upward-poled magnets 310, longitudinally-poled magnets 312, or downward-poled magnets are complementary. That is, the cross-sectional profiles may mesh to form an overall rectangular profile having a flat upper and lower surface. By way of example, the magnets may have triangular cross-sections, and each sequential magnet may be rotated 180° relative to adjacent magnets such that a magnet having a triangle vertex pointing upward is flanked by magnets having triangle vertices pointing downward. Accordingly, the profiles may mesh together to form an overall rectangular cross-sectional profile of the sequence of magnets.

Although the Halbach arrays described herein are depicted as having a direction of magnetization between adjacent elements rotated by 90 degrees, there is no such 90 degree limitation. The magnetic field direction may, however, rotate monotonically through a span of each array. As an example, Halbach array 302 in FIG. 3A could be equivalently created by an array of five elements with each field direction vector changing by 45 degrees. That is, the sequence of magnets of Halbach array 302 may have field direction vectors oriented in −90, −45, 0, 45, and 90 degrees directions. This configuration may be compared to the sequence of magnets having three elements with each field direction vector changing by 90 degrees, e.g., vectors oriented in −90, 0, and 90 degrees directions. In fact, the Halbach array 302 could be made with any number of magnetic segments of three or more, depending on a method used to create the array and the degree of resolution practically achievable to create the rotating magnetic field. By way of example, at a limit, Halbach array 302 may be composed of a single monolithic magnet structure having magnetized regions created by imparting a smoothly changing series of magnetic direction vectors without any discernable discrete magnetic direction changes within the length of the array. That is, the field direction vector may change continuously along the length of the array.

Upper magnetic Halbach array 304 may be separated from lower magnetic Halbach array 306 by a magnetic gap 308. In an embodiment, the paired magnetic Halbach arrays 302 are aligned such that magnetic flux is directed across magnetic gap 308 orthogonal to a surface of the Halbach array 302 facing magnetic gap 308. More particularly, upward-poled magnets 310 of upper Halbach array 304 and lower Halbach array 306 may be aligned along a first vertical axis 316 to direct magnetic flux upward along first vertical axis 316 through magnetic gap 308. Similarly, the downward-poled magnets 314 may be aligned along a second vertical axis 318 to direct magnetic flux downward along second vertical axis 318 through magnetic gap 308. Accordingly, the magnetic flux in a basic cell of the paired Halbach arrays 302 may follow a substantially rectangular path having a first side extending through magnetic gap 308 between upward-poled magnets 310, a second side extending through longitudinally-poled magnet 312 between upward-poled magnet 310 and downward-poled magnet 314 of upper Halbach array 304, a third side extending through magnetic gap 308 between downward-poled magnets 314, and a fourth side extending through longitudinally-poled magnet 312 between downward-poled magnet 314 and upward-poled magnet 310 of lower Halbach array 306. Longitudinally-poled magnet 312 may therefore direct flux between upward-poled magnet 310 and downward-poled magnet 314. Accordingly, longitudinally-poled magnets 312 may have a shielding effect to contain flux rather than losing that energy to a surrounding environment.

Magnetic flux of the pair of Halbach arrays 302 may interact with a voicecoil 320 of electromagnetic transducer 206. Voicecoil 320 may include a planar winding 322 disposed within magnetic gap 308. Planar winding 322 may be printed on, or otherwise adhered to, a surface of a substrate 325. For example, substrate 325 may include a flat polymer film having upper and lower surfaces facing upper Halbach array 304 and lower Halbach array 306, respectively. Accordingly, magnetic flux passing through magnetic gap 308 may also pass through voicecoil 320 orthogonal to the upper and lower surfaces of substrate 325.

The magnetic flux may pass through planar winding 322 of voicecoil 320. Planar winding 322 may include a first transverse conductor 324 in magnetic gap 308 between upward-poled magnets 310 of the pair of Halbach arrays 302. First transverse conductor 324 may conduct electrical current in a first transverse direction, e.g., leftward, along a first transverse axis 326. First transverse axis 326 may be orthogonal to first vertical axis 316, and thus, the electrical current in first transverse conductor 324 may pass orthogonally to the magnetic flux crossing magnetic gap 308 between upward-poled magnets 310. Similarly, planar winding 322 may include a second transverse conductor 327 in magnetic gap 308 between downward-poled magnets 314 of the pair of Halbach arrays 302. Second transverse conductor 327 may conduct electrical current in a second transverse direction, e.g., rightward, along a second transverse axis 328. Second transverse axis 328 may be orthogonal to second vertical axis 318, and thus, the electrical current in second transverse conductor 327 may pass orthogonally to the magnetic flux crossing magnetic gap 308 between downward-poled magnets 314. Accordingly, the electrical current running through planar winding 322 may intersect the magnetic flux extending between pairs of identically-poled magnets of the pair of Halbach arrays 302.

In an embodiment, the interaction of the electrical current and the magnetic flux causes a Lorentz force (FIG. 4) to act on planar winding 322 in a direction along a longitudinal axis 330. Longitudinal axis 330 may be orthogonal to both vertical axes, i.e., first vertical axis 316 and second vertical axis 318, and longitudinal axis 330 may be orthogonal to both transverse axes, i.e., first transverse axis 326 and second transverse axis 328. The force exerted on planar winding 322 can be transmitted to substrate 325, and thus, the Lorentz force may act on and move voicecoil 320 axially along longitudinal axis 330.

In an embodiment, voicecoil 320 may be held stationary and a surrounding structure may move relative to voicecoil 320. For example, Halbach array 302 may move relative to voicecoil 320. More particularly, voicecoil 320 may be fixed relative to a surrounding environment, and the magnets of Halbach array 302 may be suspended to allow the magnets to vibrate, i.e., oscillate relative to the magnets. In addition to altering which of voicecoil 320 or Halbach array 302 structure is fixed, sizing of the components may also be selected based on an intended application. For example, when electromagnetic transducer 206 is a vibration device, a relative size of Halbach array 302 compared to voicecoil 320 may be different than the relative size when electromagnetic transducer 206 is a speaker. More particularly, when electromagnetic transducer 206 is a vibration device, voicecoil 320 may incorporate a more massive coil and Halbach array 302 may incorporate smaller magnets to reduce a moving mass, as required by design targets of the particular application.

Electromagnetic transducer 206 may include an oscillational mass 332 physically connected to voicecoil 320. For example, a piston 334, e.g., an elongated rod having a first end connected to substrate 325 and a second end connected to oscillational mass 332, may couple voicecoil 320 to oscillational mass 332. When the interaction between the electrical current in planar winding 322 and the magnetic flux of the pair of Halbach arrays 302 drives voicecoil 320 along longitudinal axis 330, the Lorentz force may also drive oscillational mass 332 in a longitudinal direction along longitudinal axis 330. Oscillational mass 332 has an inertia, and thus, when oscillational mass 332 is driven back-and-forth along longitudinal axis 330 a vibratory effect may be transmitted to electronic device 100 housing electromagnetic transducer 206. Accordingly, electromagnetic transducer 206 may be used as a haptic feedback mechanism of electronic device 100 to transmit vibration to a user.

Figure 4:
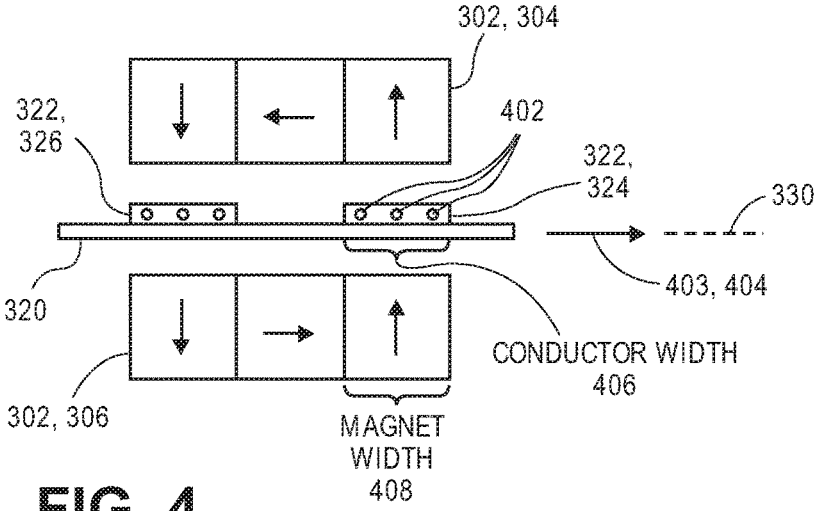
FIG. 4 is a sectional view of an electromagnetic transducer in accordance with an embodiment.

Referring to FIG. 4, a sectional view of an electromagnetic transducer is shown in accordance with an embodiment. Planar winding 322 between the paired Halbach arrays 302 may include transverse conductors formed from several winding segments. In an embodiment, first transverse conductor 324 includes several transverse winding segments 402. Transverse winding segments 402 may extend into the page along first transverse axis 326. Transverse winding segments 402 may carry electrical current orthogonal to both upward magnetic flux and longitudinal axis 330. Accordingly, a Lorentz force 403 may be generated to move voicecoil 320 in a longitudinal direction 404 along longitudinal axis 330.

The Lorentz force driving voicecoil 320 along longitudinal axis 330 depends on the interaction between the magnetic flux passing vertically through magnetic gap 308 and the electrical current passing transversely through magnetic gap 308. In an embodiment, when voicecoil 320 is in a non-energized position as shown in FIG. 4, transverse winding segments 402 may be vertically aligned with the vertically-poled magnets. Furthermore, transverse winding segments 402 may be sized to continuously interact with the magnetic flux when voicecoil 320 oscillates back-and-forth in longitudinal direction 404. For example, first transverse conductor 324 may have a conductor width 406 measured across transverse winding segments 402 in longitudinal direction 404. Similarly, each magnet of Halbach array 302 may have a magnet width measured in longitudinal direction 404. In an embodiment, magnet width 408 of the vertically-poled magnets aligned with first transverse conductor 324 may be similar to conductor width 406 of transverse winding segments 402 of first transverse conductor 324. For example, conductor width 406 may be equal to magnet width 408.

Figure 5:
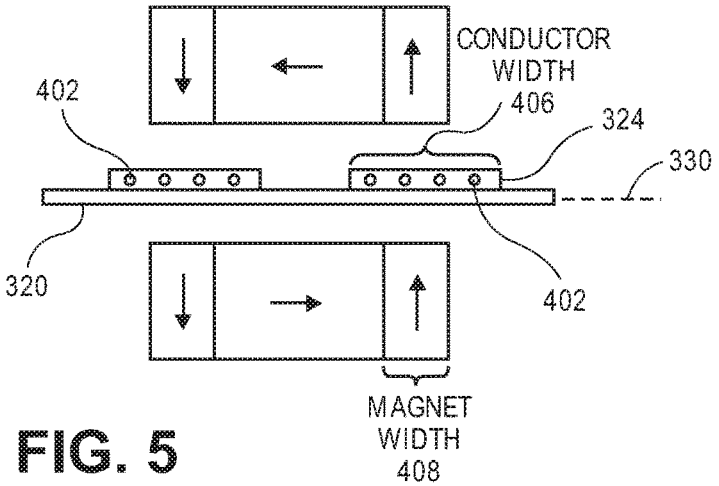
FIG. 5 is a sectional view of an electromagnetic transducer having an overhung voicecoil in accordance with an embodiment.

Referring to FIG. 5, a sectional view of an electromagnetic transducer having an overhung voicecoil is shown in accordance with an embodiment. Voicecoil 320 may be considered as being overhung when conductor width 406 of first transverse conductor 324 is greater than magnet width 408 of the vertically-poled magnets aligned with first transverse conductor 324. In such case, when voicecoil 320 oscillates along longitudinal axis 330, at least some transverse winding segments 402 may remain within the path of magnetic flux crossing through magnetic gap 308 when voicecoil 320 reaches a maximum excursion in the longitudinal direction 404 along longitudinal axis 330. By way of example, the maximum excursion may be 1.4 mm in the longitudinal direction 404 from the at rest, centered location. The motor excursion may be estimated geometrically. For example, the overhang between voicecoil 320 and vertically-poled magnets 310, 314 may be calculated, and the calculated dimension may be multiplied by a factor of 1.15 to account for a 15% fringe flux. By way of example, when conductor width 406 is 3.2 mm and vertical magnet width is 0.8 mm, a predicted excursion capability is calculated as: ((3.2 mm−0.8 mm)/2 mm)*1.15=1.4 mm.

Figure 6:
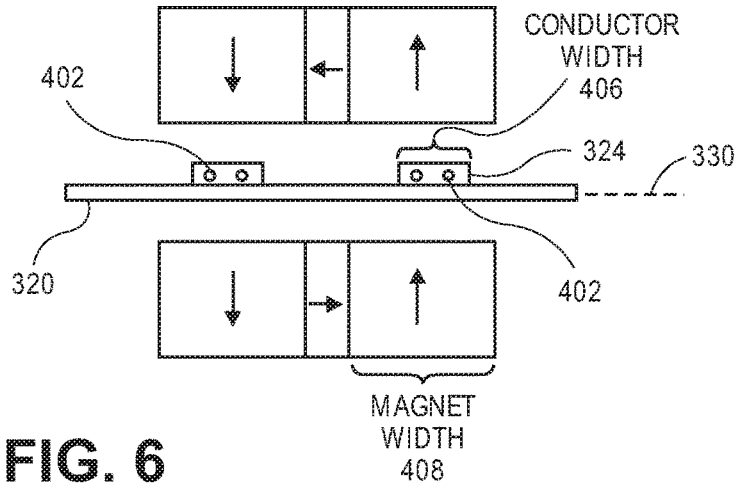
FIG. 6 is a sectional view of an electromagnetic transducer having an underhung voicecoil in accordance with an embodiment.

Referring to FIG. 6, a sectional view of an electromagnetic transducer having an underhung voicecoil is shown in accordance with an embodiment. Voicecoil 320 may be considered as being underhung when conductor width 406 of first transverse conductor 324 is less than magnet width 408 of the vertically-poled magnets aligned with first transverse conductor 324. In such case, when voicecoil 320 oscillates along longitudinal axis 330, at least some transverse winding segments 402 may remain within the path of magnetic flux crossing through magnetic gap 308 when voicecoil 320 reaches a maximum excursion in the longitudinal direction 404.

Electromagnetic interactions between magnets and conductors of electromagnetic transducer 206 can be controlled by adjusting the widths of the magnets and conductors, as described above. Similarly, electromagnetic interactions may depend on relative lengths of the magnets and conductors in a transverse direction. The concepts of overhung and underhung coils, as well as design rules for calculating the relative lengths of a conductor width and a gap width, apply in a similar fashion to traditional voicecoil motor design. For example, the vertically-poled magnets 310, 314 of electromagnetic transducer 206 are analogous to a thickness of a top plate in traditional voicecoil motor design, and conductor width 406 is analogous to a voicecoil winding height in traditional voicecoil motor design. Thus, following the above example, a traditional voicecoil motor design may include a top plate thickness of 0.8 mm, corresponding to a width of vertical magnets 310, 314, and the traditional voicecoil motor design may include a voicecoil winding height of 3.2 mm, corresponding to conductor width 406.

Figure 7:
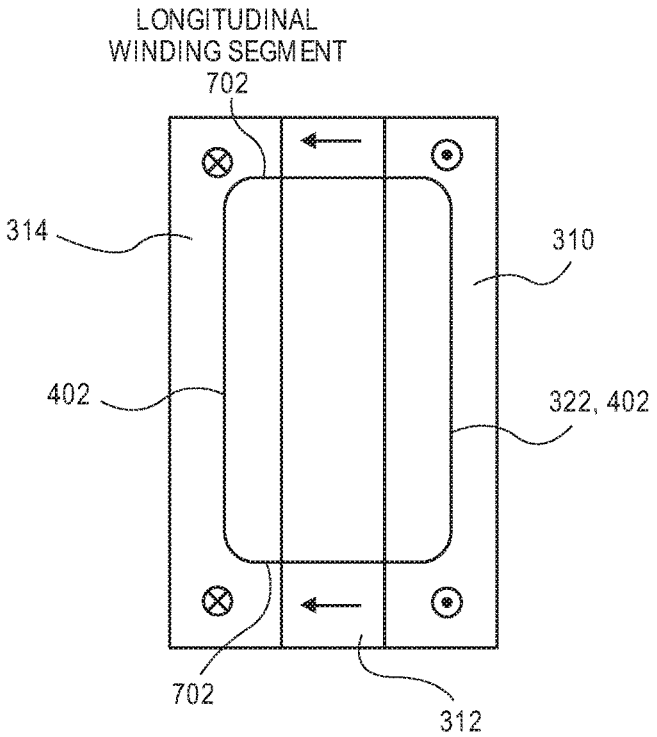
FIG. 7 is a top view of a voicecoil over a magnetic Halbach array in accordance with an embodiment.

Referring to FIG. 7, a top view of a voicecoil over a magnetic Halbach array is shown in accordance with an embodiment. A transverse length of the pair of magnetic Halbach arrays 302 may be greater than a length of transverse winding segments 402. The ends of upward-poled magnet 310 and downward-poled magnet 314 may extend beyond the ends of planar winding 322. Accordingly, longitudinal winding segments 702 of planar winding 322 may extend parallel to the magnetic flux in longitudinally-poled magnet 312 within magnetic gap 308. It will be appreciated that, insofar as longitudinal winding segments 702 carry electrical current parallel to magnetic flux carried by longitudinally-poled magnet 312, no appreciable Lorentz force is generated within the region of the motor assembly between the vertically-poled magnets.

Figure 8:
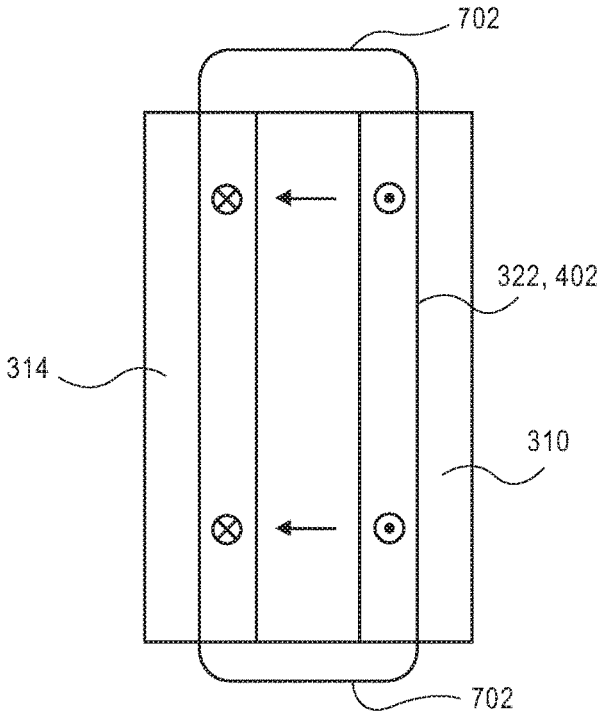
FIG. 8 is a top view of a voicecoil over a magnetic Halbach array in accordance with an embodiment.

Referring to FIG. 8, a top view of a voicecoil over a magnetic Halbach array is shown in accordance with an embodiment. The transverse length of the pair of magnetic Halbach arrays 302 may be less than a length of transverse winding segments 402. The ends of planar winding 322 may extend beyond the ends of upward-poled magnet 310 and downward-poled magnet 314. Accordingly, longitudinal winding segments 702 may extend outside of magnetic gap 308. It will be appreciated that, insofar as the electrical current in longitudinal winding segments 702 is parallel to the magnetic flux in longitudinally-poled magnets, longitudinal winding segments 702 may not contribute significantly to Lorentz force 403. Thus, electromagnetic transducer 206 may utilize the configuration shown in either of FIG. 7 or FIG. 8, depending upon factors such as space constraints within mobile device, and the configuration may provide a functional transducer.

Figure 9:
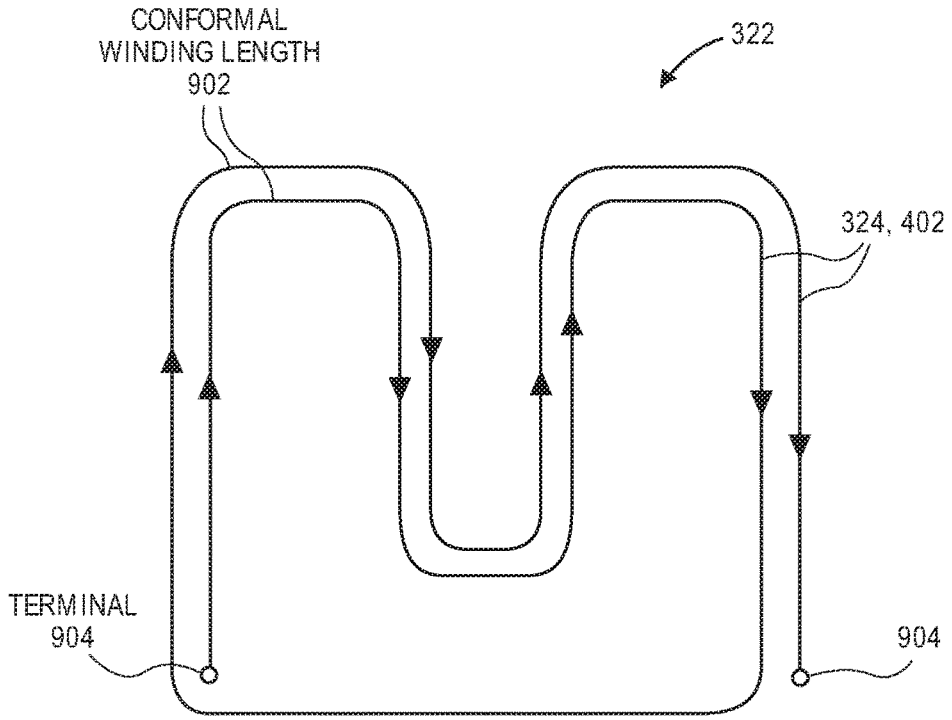
FIG. 9 is a top view of a planar winding of a voicecoil having conformal winding lengths in accordance with an embodiment.

Referring to FIG. 9, a top view of a planar winding of a voicecoil having conformal winding lengths is shown in accordance with an embodiment. Planar winding 322 may include several conformal winding lengths 902 traversing curvilinear and/or serpentine paths. Each conformal winding length 902 may be nested with an adjacent conformal winding length 902 such that several winding segments combine to form a conductor. For example, each conformal winding length 902 may include one of the transverse winding segments 402, and the combined transverse winding segments 402 may form first transverse conductor 324.

Conformal winding lengths 902 may carry electrical current in the same direction, as shown by the arrows in FIG. 9, such that the conformal winding lengths 902 interact identically with the magnetic flux in magnetic gap 308. The electrical current may be delivered to planar winding 322 through a pair of terminals 904.

Figure 10:
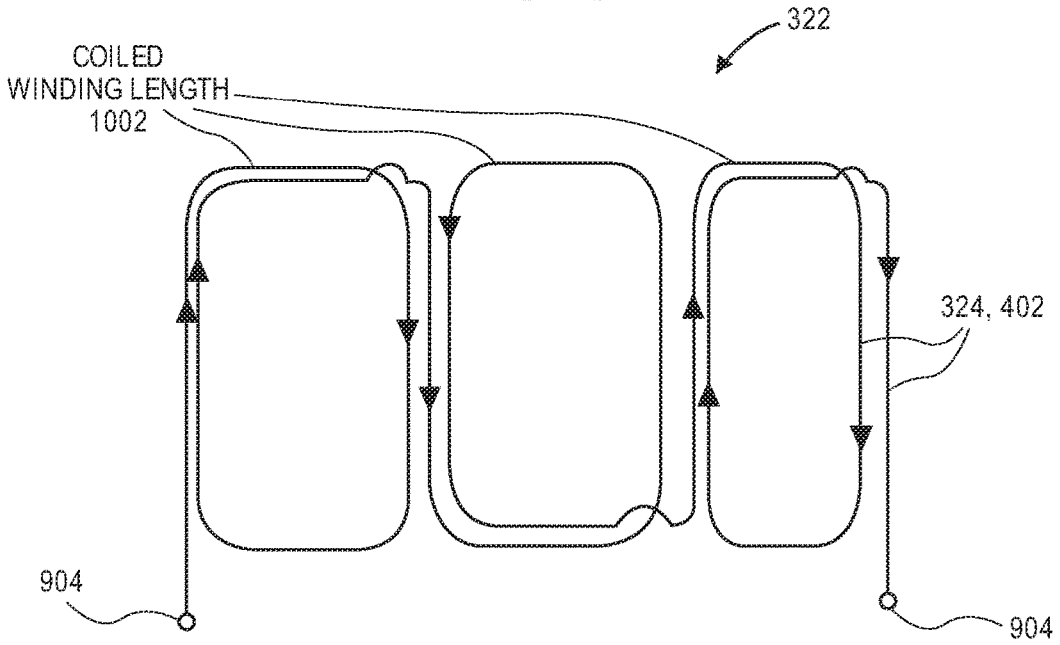
FIG. 10 is a top view of a planar winding of a voicecoil having coiled winding lengths in accordance with an embodiment.

Referring to FIG. 10, a top view of a planar winding of a voicecoil having coiled winding lengths is shown in accordance with an embodiment. Planar winding 322 may include several coiled winding lengths 1002 traversing looped paths. Each coiled winding length 1002 may be nested with an adjacent coiled winding length 1002 such that several winding segments combine to form a conductor. For example, each coiled winding length 1002 may include one of the transverse winding segments 402, and the combined transverse winding segments 402 may form first transverse conductor 324. Coiled winding lengths 1002 may carry electrical current in the same direction, as shown by the arrows in FIG. 10, such that the coiled winding lengths 1002 interact identically with the magnetic flux in magnetic gap 308. The electrical current may be delivered to planar winding 322 through terminals 904.

The winding lengths (conformal or coiled) may be disposed adjacent to one another along a transverse plane, as shown in FIGS. 9-10. Alternatively, the winding lengths may be stacked upon each other, such that adjacent winding lengths are aligned along vertical planes (not shown). For example, a first conformal winding length 902 may be stacked above a second conformal winding length 902. The first conformal winding length 902 may be on a top surface of substrate 325, and the second conformal winding length 902 may be on a bottom surface of substrate 325. An electrical connection between the vertically stacked conformal winding lengths 902 may be provided by an electrical interconnect, such as a via, extending vertically through substrate 325 from the first conformal winding length 902 to the second conformal winding length 902.

Electrical interconnections between layers of windings may be structures to maximize motor performance. For example, the structure of electrical interconnections may minimize electrical resistance. In an embodiment, electrical resistance may be decreased by reducing an overall quantity of interconnections and/or by increasing a cross-sectional area of each interconnection. Furthermore, winding patterns and layout may be chosen such that a density of conductors in the area of highest magnetic field, e.g., an amount of conductors in the area, is maximized. The density may be increased by using a minimum amount of non-conductive material between each winding segment 402 (FIG. 5). For example, by using winding segments 402 having rectangular cross-sections, rather than circular cross-sections segments as shown throughout the figures, conductive material in the area may be increased. Accordingly, it will be appreciated that circular winding cross-sections are illustrated for simplicity, but the illustrated shapes are not intended to be limiting.

The conductor packing factor of vertically-stacked windings may also be maximized by choosing winding layouts to maximize a ratio of a material of active conductors 322, 402 to a material of inactive conductor 702 (FIG. 8). The ratio may be maximized, for example, by incorporating an even number of stacked layers, e.g., two or four layers.

Conductor material may be selected from materials known to those skilled in the art. For example, conductors may be formed from copper, aluminum, silver, or alloys of these or other materials. Copper is generally chosen when higher motor strength is desired, although the increased motor strength may come at the expense of higher moving mass. An increase in mass, however, may be desirable in some applications, e.g., a wide bandwidth speaker device in a small back volume. Aluminum based alloys may have a higher conductivity to mass ratio, as compared to copper, and thus aluminum may be chosen for having a higher efficiency in some applications. For example, aluminum conductors may be desirable in devices which are intended primarily for high frequency use, such as tweeters.

Figure 11:
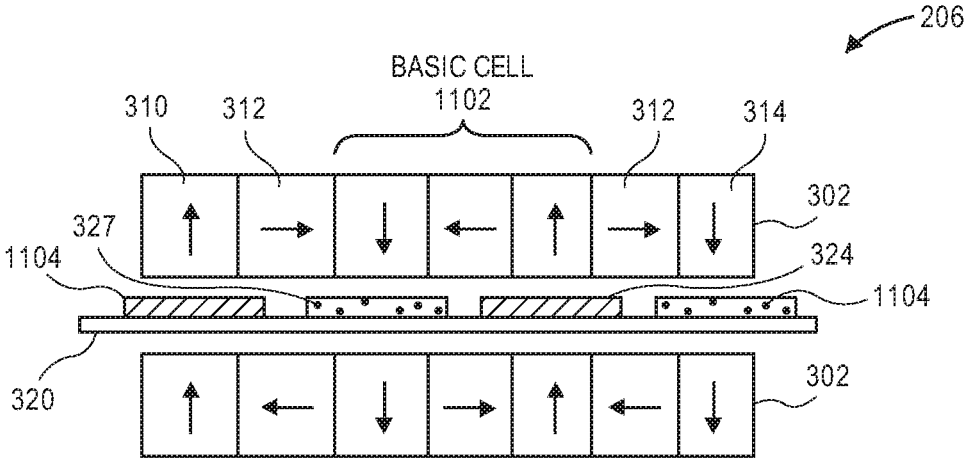
FIG. 11 is a sectional view of an electromagnetic transducer in accordance with an embodiment.

Referring to FIG. 11, a sectional view of an electromagnetic transducer is shown in accordance with an embodiment. A basic cell 1102 of the paired Halbach array 302 can be scaled up to form an electromagnetic transducer 206 of any size. More particularly, additional longitudinally-poled magnets and vertically-poled magnets may be sequentially according to the 90° pole shifting scheme, as described above. Furthermore, voicecoil 320 may include additional conductors 1104 adjacent to first transverse conductor 324 and second transverse conductor 327 to grow the motor assembly of electromagnetic transducer 206 in the longitudinal direction 404.

Figure 12:
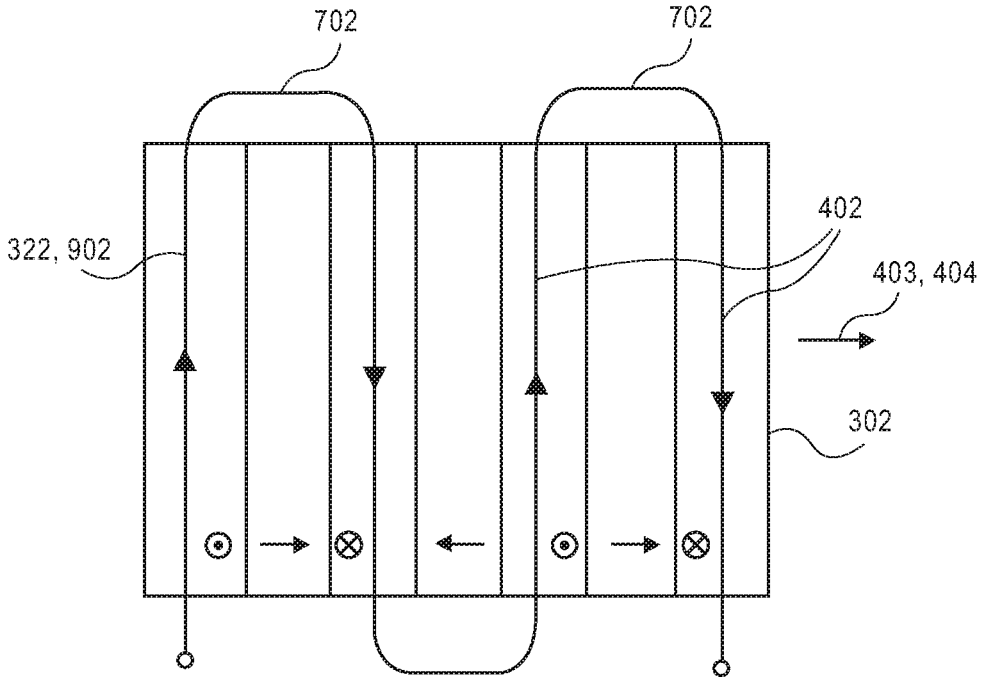
FIG. 12 is a top view of a voicecoil over a magnetic Halbach array in accordance with an embodiment.

Referring to FIG. 12, a top view of a voicecoil over a magnetic Halbach array is shown in accordance with an embodiment. In an embodiment, the scaled up motor assembly shown in FIG. 11 includes planar winding 322 having conformal winding length 902 traversing a serpentine path between the pair of Halbach arrays 302. Each transverse winding segment 402 of conformal winding length 902 may extend orthogonally to a direction of magnetic flux in magnetic gap 308. Adjacent transverse winding segments 402 may carry the electrical current in opposite directions, and adjacent vertically-poled magnets may direct magnetic flux in opposite directions, such that Lorentz force 403 applied to voicecoil 320 is in a same longitudinal direction 404. In an embodiment, adjacent transverse winding segments 402 are interconnected by longitudinal winding segments 702. Transverse winding segments 402 may be longer than a transverse length of the magnets, and accordingly, longitudinal winding segments 702 may extend parallel to ends of the pair of Halbach arrays 302 outside of magnetic gap 308.

Figure 13:
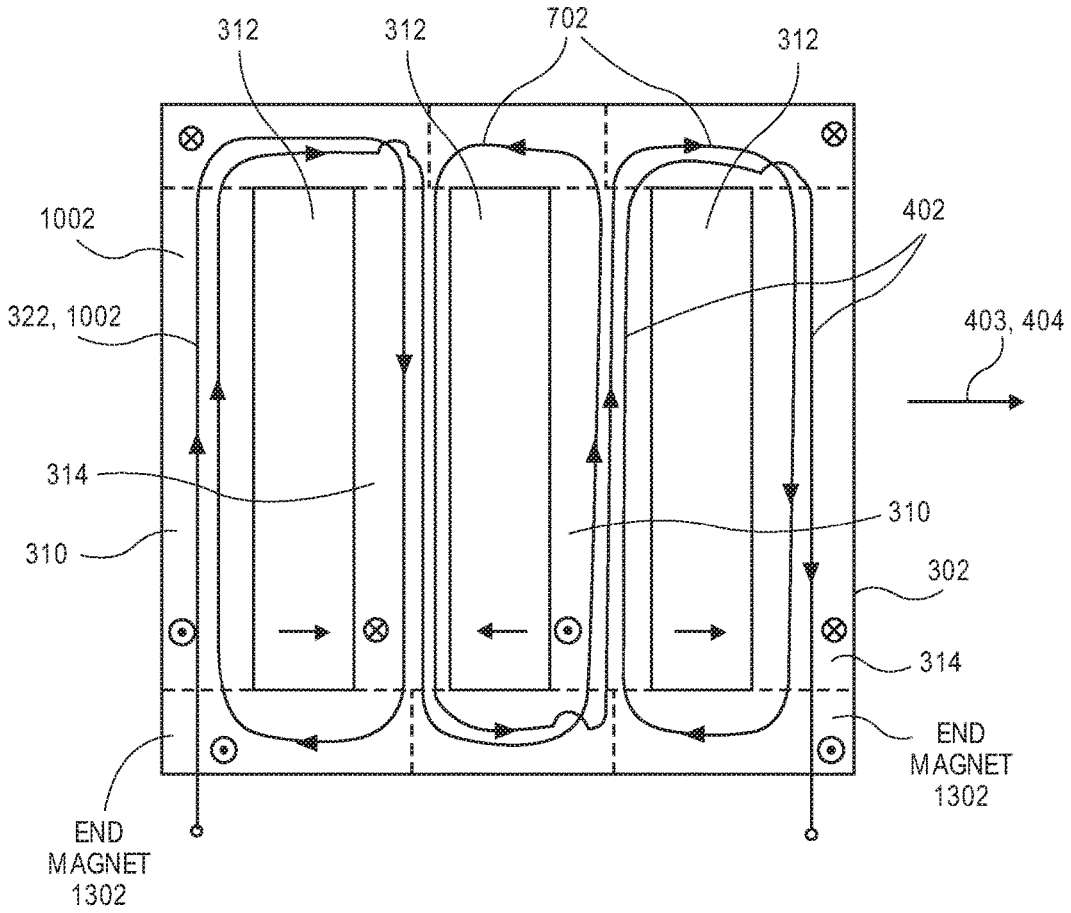
FIG. 13 is a top view of a voicecoil over a magnetic Halbach array having end magnets in accordance with an embodiment.

Referring to FIG. 13, a top view of a voicecoil over a magnetic Halbach array having end magnets is shown in accordance with an embodiment. In an embodiment, the scaled up motor assembly shown in FIG. 11 includes planar winding 322 having coiled winding length 1002 traversing a looped path between the pair of Halbach arrays 302. Each transverse winding segment 402 of coiled winding length 1002 may extend orthogonally to a direction of magnetic flux in magnetic gap 308. Adjacent transverse winding segments 402 may carry the electrical current in opposite directions, and adjacent vertically-poled magnets may direct magnetic flux in opposite directions, such that Lorentz force 403 applied to voicecoil 320 is in a same longitudinal direction 404. In an embodiment, adjacent transverse winding segments 402 are interconnected by longitudinal winding segments 702. Longitudinal winding segments 702 may carry the electrical current in opposite directions as required by the respective loop structures of coiled winding length 1002.

In an embodiment, the pair of magnetic Halbach arrays 302 incorporate end magnets 1302 to allow all lengths of planar winding 322 to be useful. For example, each magnetic Halbach array 302 may include an end magnet 1302 extending in longitudinal direction 404 between a respective upward-poled magnet 310 and downward-poled magnet 314. Each end magnet 1302 may be poled in a vertical direction, i.e., upward or downward. Accordingly, the poling of each end magnet 1302 may be in a direction orthogonal to a direction that electrical current is carried through longitudinal winding segments 702. As such, the electrical current in longitudinal winding segments 702 of planar winding 322 within magnetic gap 308 between end magnets 1302 may interact with the magnetic flux in end magnets 1302 to produce a respective Lorentz force. The Lorentz force generated by end magnets 1302 may be in a transverse direction, e.g., leftward or rightward. Accordingly, the force applied to the voicecoil 320 by end magnets 1302 may be in a different direction than the force applied to voicecoil 320 by the longitudinally extending magnets. Therefore, a net force may be applied to voicecoil 320 in an oblique direction based on a sum of the longitudinal and transverse forces. The oblique forces may nonetheless generate vibration of a haptic feedback mechanism in mobile electronic device 100.

Magnetic Halbach arrays 302 having variously poled regions may be fabricated using different techniques. In an embodiment, vertically-poled magnets of the Halbach array 302 are poled using impulse magnetization. For example, a miniature impulse magnetizer can magnetize a surface of Halbach array 302 to form the various vertically-poled regions, including end magnets 1302. Impulse magnetization may be incapable of forming longitudinally-poled regions of Halbach array 302, and thus, those regions may be formed by first removing material from the vertically-poled magnet, and then inserting bar magnets having the longitudinally-poled orientation into the holes. The inserts may be fixed in place, e.g., by an adhesive, to fabricate a sheet of magnetic material having differently poled regions.

Halbach arrays 302 may include structures to channel magnetic flux. For example, a backer material, e.g., a thin sheet of steel, may be mounted on one or both of the Halbach arrays 302 opposite of magnetic gap 308. Accordingly, magnetic flux directed through magnetic gap 308 into a vertically-poled Halbach array 302 may be channeled through both longitudinally-poled magnet and the backer material into an adjacent vertically-poled magnet. Similarly, steel plates may be mounted at the ends of Halbach arrays 302 to direct magnetic flux vertically between leftmost and/or rightmost vertically-poled magnets of Halbach array 302. That is, the steel plates at the end of the Halbach arrays 302 may act as magnetic flux returns structures to constrain magnetic flux within the paired Halbach arrays 302 rather than losing the magnetic flux to a surrounding environment. Magnetically, the ferromagnetic backer may affect the motor strength insubstantially in certain embodiments, due to a self-shielding nature of Halbach array 302. It may nonetheless be desirable to use a ferromagnetic backer for structural purposes. For example, a backer plate may facilitate mechanical assembly of electromagnetic transducer 206 by providing an attachment surface to make fixturing, transferring, etc., easier to perform.

Although mainly described with respect to incorporation in a haptic feedback mechanism above, electromagnetic transducer 206 may be an electroacoustic transducer 208. More particularly, voicecoil 320 and paired magnetic Halbach arrays 302 described above may form a motor assembly of an audio speaker, e.g., microspeaker 102.

Figure 14:
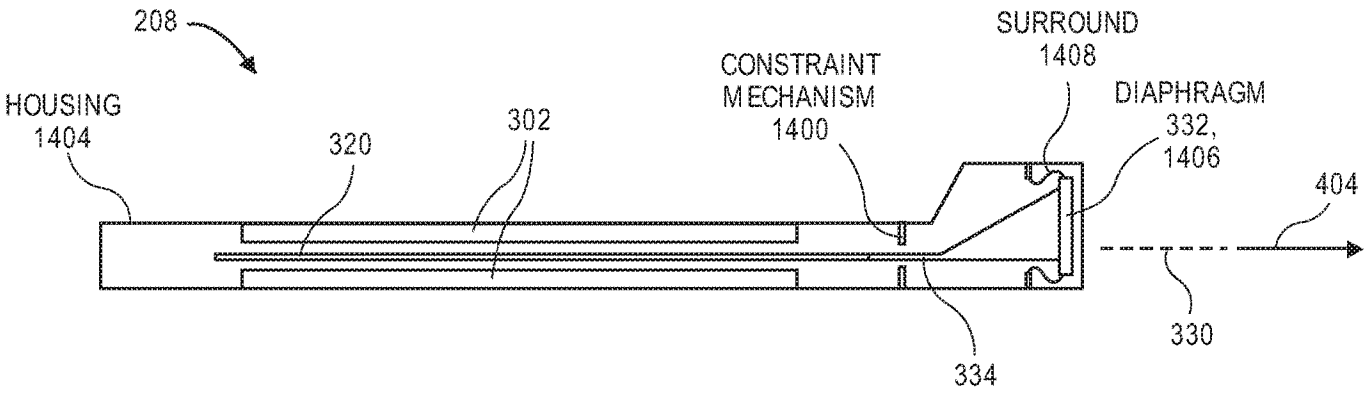
FIG. 14 is a sectional view of an electroacoustic transducer in accordance with an embodiment.

Referring to FIG. 14, a sectional view of an electroacoustic transducer is shown in accordance with an embodiment. Electroacoustic transducer 208 may include a speaker housing 1404 containing speaker components. The speaker components may include a motor assembly having voicecoil 320 and paired Halbach arrays 302. In an embodiment, oscillational mass 332 includes a speaker diaphragm 1406. Accordingly, the motor assembly may drive diaphragm 1406 back-and-forth along longitudinal axis 330 to generate sound.

It will be appreciated that the motor assembly of electroacoustic transducer 208 may be similar or identical to the motor assembly described above with respect to electromagnetic transducer 206. More particularly, the motor construction described above with respect to electromagnetic transducer 206 has application in areas beyond haptic feedback mechanisms such as trackpad feedback, and may be applied in areas such as vibration motors and loudspeaker applications. Accordingly, in the interest of brevity, the motor assembly will not be described again here. In the case of electroacoustic transducer 208, however, a transducer may include additional components related to the generation of sound. For example, piston 334 may connect voicecoil 320 to diaphragm 1406 to drive diaphragm 1406 and generate sound. Electroacoustic transducer 208 may also have one or more constraint mechanism 1400 to constrain diaphragm 1406 along longitudinal axis 330. More particularly, diaphragm 1406 may be driven axially along longitudinal axis 330 orthogonal to the vertical axes of the pair of Halbach arrays 302 and the transverse axes of the various conductors of voicecoil 320. Piston 334 may have an elongated section, e.g., a rod-like section, extending through a slot or a hole in a constraint mechanism 1400. The hole may be sized to receive piston 334 in a sliding relationship, and the constraint mechanism 1400 may acts as a bearing such that piston 334 may move along longitudinal axis 330 to drive diaphragm 1406 in longitudinal direction 404. Constraint mechanism 1400 may, however, restrict movement of diaphragm 1406 in a vertical or transverse direction orthogonal to longitudinal axis 330. That is, constraint mechanism 1400 may constrain oscillational mass 332 to move axially along longitudinal axis 330 such that sound is emitted in longitudinal direction 404.

In an embodiment, movement of diaphragm 1406 is constrained by a speaker surround 1408. For example, surround 1408 may connect the diaphragm 1406 to speaker housing 1404, and surround 1408 may flex to allow movement along longitudinal axis 330 and to restrict movement in a transverse directions orthogonal to longitudinal axis 330. Surround 1408 may also provide an acoustic seal separating air on a rear side of diaphragm 1406 from air on a front side of diaphragm 1406. Accordingly, the motor assembly may generate a Lorentz force to drive piston 334 and diaphragm 1406 back-and-forth in longitudinal direction 404 such that sound is generated and emitted by electroacoustic transducer 208

Figure 15:
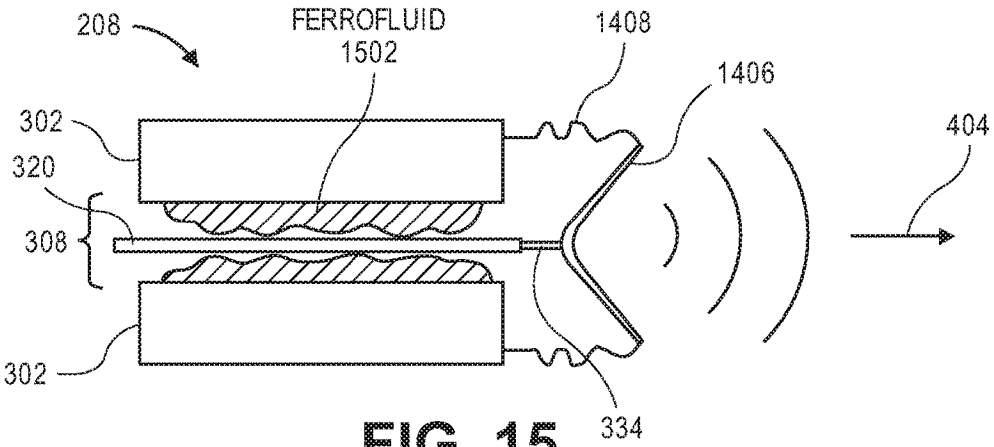
FIG. 15 is a sectional view of an electroacoustic transducer in accordance with an embodiment.

Referring to FIG. 15, a sectional view of an electroacoustic transducer is shown in accordance with an embodiment. Electroacoustic transducer 208 may incorporate voicecoil 320 driven parallel to magnetic gap 308 between Halbach arrays 302. Magnetic gap 308 of electroacoustic transducer 208 having paired Halbach arrays 302 may be less than a magnetic gap required to drive voicecoil 320 in a direction transverse to longitudinal axis 330. More particularly, since voicecoil 320 need only slide back-and-forth within magnetic gap 308, and is not required to flex up and down in a direction orthogonal to the Halbach arrays 302, a vertical width of magnetic gap 308 may be reduced. The vertical width may be a dimension only slightly larger than the vertical thickness of voicecoil 320. By way of example, an overall thickness of electroacoustic transducer 208, including the pair of magnetic Halbach arrays 302 and voicecoil 320, may be less than 0.2 mm.

In an embodiment, a ferrofluid 1502 may be disposed within magnetic gap 308 between voicecoil 320 and the pair of magnetic Halbach arrays 302. Ferrofluid 1502 is a colloidal liquid made of nanoscale ferromagnetic, or ferromagnetic particles, suspended in a carrier fluid such as an organic solvent or water. Ferrofluid 1502 may act as a bearing to reduce friction and facilitate movement of voicecoil 320 in longitudinal direction 404. Furthermore, ferrofluid 1502 may act as a heat sink material to dissipate heat generated by the movement of voicecoil 320. Ferrofluid 1502 is drawn to an area of highest magnetic field, and thus, it may be held in place by magnetic forces of Halbach arrays 302. Accordingly, ferrofluid 1502 may provide a fluid bearing that is resistant to undesirable motion of voicecoil 320, and may maintain voicecoil 320 in a centered position within magnetic gap 308.

Figure 16:
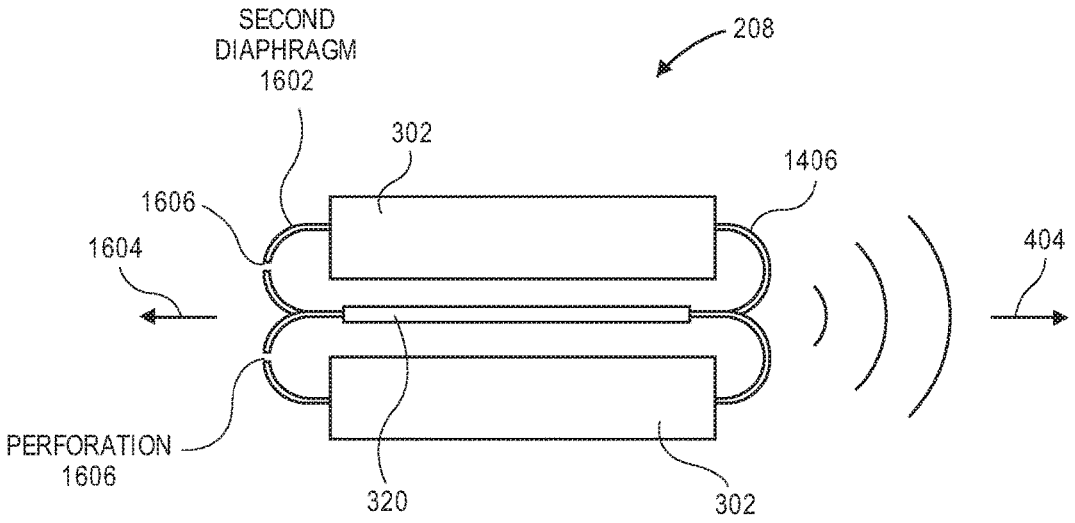
FIG. 16 is a sectional view of an electroacoustic transducer in accordance with an embodiment.

Referring to FIG. 16, a sectional view of an electroacoustic transducer is shown in accordance with an embodiment. Electromagnetic transducer 206 and/or electroacoustic transducer 208 may include a second diaphragm 1602 coupled to voicecoil 320 on an opposite side of magnetic Halbach arrays 302 than diaphragm 1406. For example, diaphragm 1406 may face longitudinal direction 404, and second diaphragm 1602 may face a second longitudinal direction 1604 opposite of longitudinal direction 404. Longitudinal direction 404 and second longitudinal direction 1604 may both be along longitudinal axis 330, and thus, Lorentz force 403 may drive both diaphragm 1406 and second diaphragm 1602 back-and-forth along longitudinal axis 330 in longitudinal direction 404 and second longitudinal direction 1604.

Diaphragm 1406 and second diaphragm 1602 may be supported relative to magnetic Halbach arrays 302 by respective suspensions. The suspensions may constrain movement of the diaphragms 1406 along longitudinal axis 330 such that oscillations of voicecoil 320 within magnetic gap 308 cause the diaphragm to emit sounds in one or more of longitudinal direction 404 or second longitudinal direction 1604. That is, sound may be emitted from both sides of electroacoustic transducer 208.

In an embodiment, electroacoustic transducer 208 having diaphragm 1406 and second diaphragm 1602 emits sound in a single direction. For example, second diaphragm 1602 may include one or more perforation 1606. The perforated end of electroacoustic transducer 208, i.e., the perforated second diaphragm 1602, may allow sound to pass between the surrounding environment and the magnetic gap 308. Thus, second diaphragm 1602 may not generate sound. Nonetheless, second diaphragm 1602 and the surround 1408 supporting second diaphragm 1602 may act to constrain movement of voicecoil 320. Accordingly, sound generated by diaphragm 1406 may be influenced at least in part by the presence of a perforated second diaphragm 1602.

Figure 17:
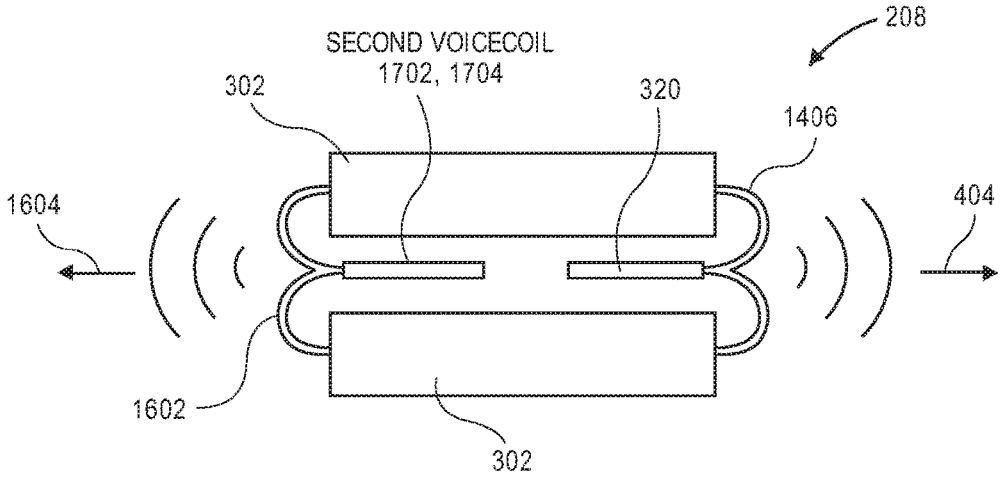
FIG. 17 is a sectional view of an electroacoustic transducer in accordance with an embodiment.

Referring to FIG. 17, a sectional view of an electroacoustic transducer is shown in accordance with an embodiment. In an embodiment, electroacoustic transducer 208 includes voicecoil 320 to move diaphragm 1406 in longitudinal direction 404, as described above. Electroacoustic transducer 208 may also include a second voicecoil 1702 to move second diaphragm 1602 in second longitudinal direction 1604. More particularly, second voicecoil 1702 may move independently from voicecoil 320 within magnetic gap 308. Second voicecoil 1702 may include a second planar winding 1704 mounted on a second substrate within magnetic gap 308. The interaction between second planar winding 1704 and magnetic Halbach arrays 302 may be such that a second Lorentz force is generated to drive second voicecoil 1702 in second longitudinal direction 1604 opposite to longitudinal direction 404. For example, second planar windings 1704 may carry electrical current in an opposite direction as compared to planar winding 322 of voicecoil 320. Second voicecoil 1702 may be coupled to second diaphragm 1602, and thus, the second Lorentz force 403 may drive second diaphragm 1602 and second longitudinal direction 1604.

Figure 18:
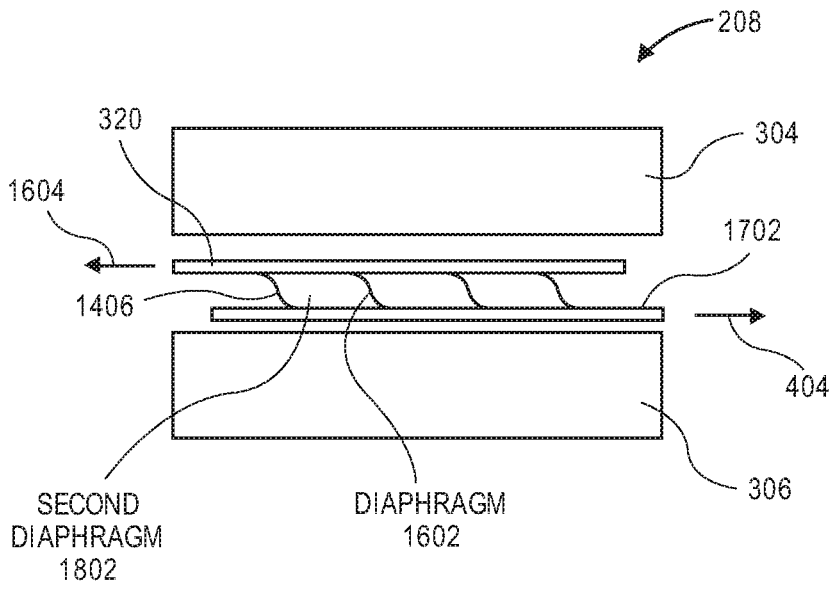
FIG. 18 is a sectional view of an electroacoustic transducer in accordance with an embodiment.

Referring to FIG. 18, a sectional view of an electroacoustic transducer is shown in accordance with an embodiment. Electroacoustic transducer 208 may include several voicecoils occupying a same vertical space within magnetic gap 308. More particularly, second voicecoil 1702 may be disposed within magnetic gap 308 between voicecoil 320 and lower magnetic Halbach array 306. Each voicecoil 320 may include respective planar windings 322 carrying an electrical current in opposite directions from one another such that the voicecoils 320 interact with a same magnetic flux differently. That is, the magnetic flux passing through voicecoil 320 along a vertical axis may generate a Lorentz force 403 that drives voicecoil 320 in longitudinal direction 404, and the same magnetic flux may pass through second voicecoil 1702 along the vertical axis to generate a second Lorentz force that drives second voicecoil 1702 in second longitudinal direction 1604. Thus, electroacoustic transducer 208 may include independent voicecoils 320 configured to move in opposite directions within the same magnetic field.

In an embodiment, the independently moving voicecoils 320 suspended in magnetic gap 308 may support several diaphragms 1406. For example, diaphragm 1406 may extend between voicecoil 320 and second voicecoil 1702 at a first longitudinal location, and a second diaphragm 1602 may extend between voicecoil 320 and second voicecoil 1702 at a second longitudinal location. Diaphragm 1406 may therefore be longitudinally offset from second diaphragm 1602 such that an air volume 1802 is defined between the voicecoils 320, 1702 and the diaphragms 1406, 1602.

Figure 19A:
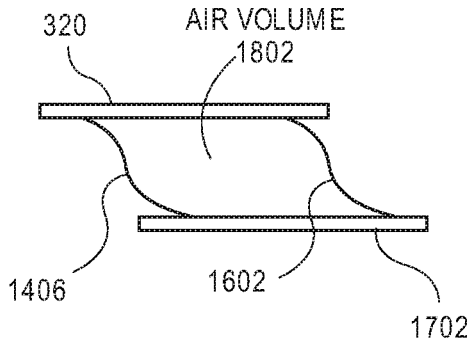
FIG. 19A-19B are detail views of an electroacoustic transducer in accordance with an embodiment.
Figure 19B:
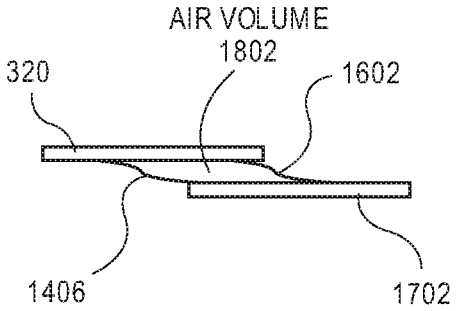

Referring to FIG. 19A-19B, detail views of an electroacoustic transducer is shown in accordance with an embodiment. Relative movement between voicecoil 320 and second voicecoil 1702 can actuate the diaphragms to cause a change in air volume 1802. More particularly, air volume 1802 may change when voicecoils 320, 1702 are driven in longitudinal direction 404. The voicecoils and diaphragms defining air volume 1802 may have a cross-sectional profile resembling a parallelogram. As the voicecoils move relative to each other, an angle of the sides of the parallelogram increases or decreases, causing air volume 1802 to expand or contract, respectively. Furthermore, as the parallelogram changes, air is expelled or drawn into air volume 1802. Accordingly, the change in air volume 1802 can move air to generate sound.

Figure 20:
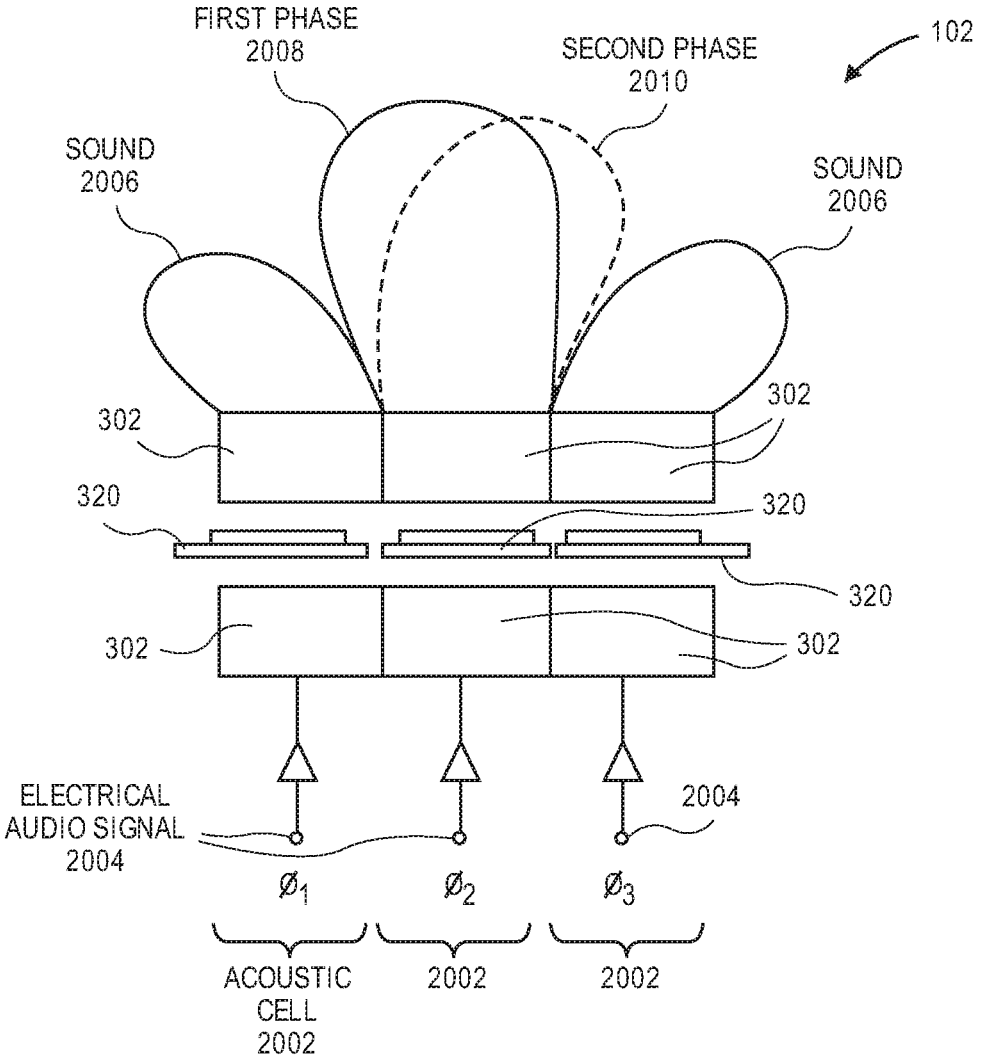
FIG. 20 is a sectional view of an electroacoustic transducer having independently driven acoustic cells in accordance with an embodiment.

Referring to FIG. 20, a sectional view of an electroacoustic transducer having independently driven acoustic cells is shown in accordance with an embodiment. A microspeaker may include one or more acoustic cells 2002. An acoustic cell 2002 may be defined as one of the electroacoustic transducer units described above, having a motor assembly connected to a diaphragm 1406 to generate sound. Each acoustic cell 2002 may furthermore include the basic cell 1102 of electromagnetic transducer 206 having paired Halbach arrays 302. In an embodiment, a micro speaker 102 includes several acoustic cells 2002 to independently generate sounds based on electrical audio signals 2004 received from processor(s) 202.

In an embodiment, a micro speaker 102 includes several acoustic cells 2002 arranged sequentially within a housing. Each acoustic cell 2002 may include a respective voicecoil 320 between a respective pair of magnetic Halbach arrays 302. As shown in FIG. 20, the voicecoils 320 may be driven in respective longitudinal directions, which may be into the page in the illustration. More particularly, the voicecoils 320 of the acoustic cells 2002 may receive independent electrical audio signals 2004 from processor 202 to generate respective Lorentz forces that move the voicecoils 320. That is, the processor 202 may drive each acoustic cell 2002 with a different audio channel. The different audio channels can create phase relationships between the acoustic cells 2002 to control sound emitted by each cell. The respective movements may generate respective sounds having respective amplitudes and phases. For example, during a first time period and a second time period, a leftward and rightward acoustic cell 2002 may be driven with constant electrical audio signals 2004 such that sounds 2006 generated by those acoustic cells 2002 remains the same. By contrast, during the first time period a middle acoustic cell 2002 may be driven by an electrical audio signal 2004 to produce sound 2008 having a first amplitude and phase, and during the second time period the middle acoustic cell 2002 may be driven by a different electrical audio signal 2004 to produce sound 2010 having a second amplitude in phase (represented by a dotted line). The difference in phase relationships may allow for a net sound, i.e., a sum of the individual sounds generated by respective acoustic cells 2002, to be directed. That is, altering the electrical audio signals 2004 can be used to change a perceived direction of sound emitted by the micro speaker 102. Accordingly, the microspeaker may be useful in a beam forming application.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. An electromagnetic transducer, comprising:

a magnetic return structure;

a first magnetic Halbach array separated from the magnetic return structure by a magnetic gap, wherein the first magnetic Halbach array includes a first upward-poled magnet and a first downward-poled magnet, wherein the first upward-poled magnet directs magnetic flux upward along a first vertical axis through the magnetic gap, and wherein the first downward-poled magnet directs magnetic flux downward along a second vertical axis through the magnetic gap; and a voicecoil including a planar winding within the magnetic gap, wherein the planar winding includes a first transverse conductor between the first upward-poled magnet and the magnetic return structure to conduct electrical current leftward along a first transverse axis orthogonal to the first vertical axis, and a second transverse conductor between the first downward-poled magnet and the magnetic return structure to conduct electrical current rightward along a second transverse axis orthogonal to the second vertical axis such that the electrical currents intersect the magnetic fluxes to cause a Lorentz force to move the voicecoil axially along a longitudinal axis orthogonal to both vertical axes and both transverse axes.

2. The electromagnetic transducer of claim 1, wherein the magnetic return structure includes a second magnetic Halbach array including a second upward-poled magnet and a second downward-poled magnet, wherein the upward-poled magnets are aligned along the first vertical axis, and wherein the downward-poled magnets are aligned along the second vertical axis.

3. The electromagnetic transducer of claim 2 further comprising a speaker diaphragm coupled to the voicecoil, wherein the Lorentz force drives the speaker diaphragm.

4. The electromagnetic transducer of claim 3 further comprising:

a piston to couple the voicecoil to the speaker diaphragm; and a constraint mechanism coupled to the piston to constrain the speaker diaphragm to move axially along the longitudinal axis.

5. The electromagnetic transducer of claim 1, wherein the first transverse conductor includes a plurality of transverse winding segments, and wherein the first transverse conductor includes a conductor width across the transverse winding segments in a longitudinal direction.

6. The electromagnetic transducer of claim 5, wherein the planar winding includes a plurality of conformal winding lengths, and wherein each conformal winding length includes one of the plurality of transverse winding segments.

7. The electromagnetic transducer of claim 5, wherein the planar winding includes a plurality of coiled winding lengths, and wherein each coiled winding length includes one of the plurality of transverse winding segments.

8. The electromagnetic transducer of claim 5, wherein the upward-poled magnets have a magnet width, and wherein the conductor width is greater than the magnet width.

9. The electromagnetic transducer of claim 1, wherein each magnetic Halbach array includes a longitudinally-poled magnet between the upward-poled magnet and the downward-poled magnet to direct magnetic flux between the upward-poled magnet and the downward-poled magnet.

10. The electromagnetic transducer of claim 9, wherein each magnetic Halbach array includes an end magnet extending in a longitudinal direction between the upward-poled magnet and the downward-poled magnet, wherein the end magnet is poled in a vertical direction, and wherein the planar winding is within the magnetic gap between the end magnets.

11. An electroacoustic transducer, comprising:

a pair of magnetic Halbach arrays, the pair including an upper magnetic Halbach array separated from a lower magnetic Halbach array by a magnetic gap, wherein each magnetic Halbach array includes an upward-poled magnet and a downward-poled magnet, wherein the upward-poled magnets are aligned along a first vertical axis to direct magnetic flux upward along the first vertical axis through the magnetic gap, and wherein the downward-poled magnets are aligned along a second vertical axis to direct magnetic flux downward along the second vertical axis through the magnetic gap;

a voicecoil including a planar winding within the magnetic gap, wherein the planar winding includes a first transverse conductor between the upward-poled magnets to conduct electrical current leftward along a first transverse axis orthogonal to the first vertical axis, and a second transverse conductor between the downward-poled magnets to conduct electrical current rightward along a second transverse axis orthogonal to the second vertical axis such that the electrical currents intersect the magnetic fluxes to cause a Lorentz force to move the voicecoil in a longitudinal direction; and a diaphragm coupled to the voicecoil, wherein the Lorentz force drives the diaphragm to generate sound.

12. The electroacoustic transducer of claim 11, wherein the Lorentz force drives the diaphragm axially along a longitudinal axis orthogonal to both vertical axes and both transverse axes.

13. The electroacoustic transducer of claim 12, wherein the diaphragm is coupled to the voicecoil by a piston, and wherein the piston moves along the longitudinal axis to drive the diaphragm in the longitudinal direction.

14. The electroacoustic transducer of claim 11, further comprising a ferrofluid within the magnetic gap between the voicecoil and the pair of magnetic Halbach arrays.

15. The electroacoustic transducer of claim 11, further comprising a second diaphragm coupled to the voicecoil, wherein the Lorentz force drives the second diaphragm in the longitudinal direction.

16. The electroacoustic transducer of claim 11, further comprising:

a second voicecoil having a second planar winding within the magnetic gap; and a second diaphragm coupled to the second voicecoil, wherein a second Lorentz force drives the second diaphragm in a second longitudinal direction opposite to the longitudinal direction.

17. The electroacoustic transducer of claim 11, further comprising:

a second voicecoil between the voicecoil and the lower magnetic Halbach array, wherein the diaphragm extends between the voicecoil and the second voicecoil; and a second diaphragm extending between the voicecoil and the second voicecoil;

wherein an air volume is defined between the voicecoils and the diaphragms, and wherein the air volume changes when the voicecoil is driven in the longitudinal direction to generate sound.

18. A mobile electronic device, comprising:

a housing;

a processor; and a micro speaker coupled with the housing and the processor, wherein the micro speaker includes one or more acoustic cells, each acoustic cell including:

a pair of magnetic Halbach arrays, the pair including an upper magnetic Halbach array separated from a lower magnetic Halbach array by a magnetic gap, wherein each magnetic Halbach array includes an upward-poled magnet and a downward-poled magnet, wherein the upward-poled magnets are aligned along a first vertical axis to direct magnetic flux upward along the first vertical axis through the magnetic gap, and wherein the downward-poled magnets are aligned along a second vertical axis to direct magnetic flux downward along the second vertical axis through the magnetic gap;

a voicecoil including a planar winding within the magnetic gap, wherein the planar winding includes a first transverse conductor between the upward-poled magnets to conduct electrical current leftward along a first transverse axis orthogonal to the first vertical axis, and a second transverse conductor between the downward-poled magnets to conduct electrical current rightward along a second transverse axis orthogonal to the second vertical axis such that the electrical currents intersect the magnetic fluxes to cause a Lorentz force to move the voicecoil in a longitudinal direction; and a diaphragm coupled to the voicecoil, wherein the Lorentz force drives the diaphragm to generate sound.

19. The mobile electronic device of claim 18, wherein the diaphragm is coupled to the voicecoil by a piston, wherein the diaphragm is coupled to the housing by a surround, and wherein the piston moves the diaphragm in the longitudinal direction.

20. The mobile electronic device of claim 18, wherein the one or more acoustic cells include a plurality of acoustic cells, and wherein the voicecoils of the acoustic cells receive independent electrical audio signals from the processor to generate respective sounds having respective amplitudes and phases.

* * * * *